United States Patent [19]

Smith

[11] 4,026,032

[45] May 31, 1977

[54] BOW SIGHT MECHANISM

[76] Inventor: Jimmie Thomas Smith, 6737 E. 5th Place, Tulsa, Okla. 74112

[22] Filed: Oct. 28, 1975

[21] Appl. No.: 626,357

[52] U.S. Cl. ..... 33/265; 124/87
[51] Int. Cl.[2] ..... F41G 1/00
[58] Field of Search ..... 124/87, 24 R, 23 R, 124/25; 33/265

[56] References Cited

UNITED STATES PATENTS

| | | | |
|---|---|---|---|
| 2,900,973 | 8/1959 | Diehr | 124/24 R |
| 3,056,206 | 10/1962 | Moore | 33/265 |
| 3,163,938 | 1/1965 | Reynolds | 33/265 |
| 3,365,800 | 1/1968 | Carella | 33/265 |
| 3,696,517 | 10/1972 | Larson | 33/265 |
| 3,865,095 | 2/1975 | Helmick | 124/24 R |

*Primary Examiner*—Richard C. Pinkham
*Assistant Examiner*—William R. Browne
*Attorney, Agent, or Firm*—Head, Johnson & Chafin

[57] ABSTRACT

A bow sight mechanism mounted on an archer's bow above the handle and arrow guide and having a plurality of individually adjustable sighting pins, each pin having a sighting bead on one end thereof. A block guide member attaches to the bow and has a vertical slot for slidably receiving the sighting pins therethrough. Each sighting pin carries an attachment to permit adjustability of the pin vertically for range and horizontally for windage. The pins may be locked against the vertical movement for setting in the range while still adjustable horizontally for windage corrections. A resilient washer is used against one side of the slid block member interposed between a nut member on the opposite side of the guide block member whereby tightening the nut member against the guide block member will force the resilient washer against the slide block member and pin and cause locking of the pin in a selected vertical position on the slide block member.

6 Claims, 12 Drawing Figures

BOW SIGHT MECHANISM

BACKGROUND OF THE INVENTION

1. Field of the Invention

The present invention relates to sighting mechanisms and more particularly, not by way of limitation, to a bow sight which is attachable to a conventional bow frame above the handle and arrow rest and is adjustable both vertically and horizontally for range and windage, respectively.

2. Description of the Prior Art

Heretofore, there have been various bow sights having beaded pins which are adjustable for both range and windage. It is generally the case that prior to the use of a bow in the field, the archer makes his range, or vertical, adjustments of his sighting mechanisms on a target range and then the sighting mechanism is locked into place. However, the windage, or horizontal, adjustments have to be made in accordance with the environmental conditions in the field prevailing at the time of use.

In the presently available sighting mechanisms, windage adjustments in the field require first loosening the range locking mechanism and then relocking after the windage adjustment has been made. This can be disastrous if the range adjustment of the mechanism is altered while setting the windage. In other words, if the range adjustment is accidentally moved, it requires a trip back to a calibrated target range in order to reset the range adjustments.

Other available bow sight mechanisms are rather delicately made and can often be thrown out of adjustment by scraping the bow against brush and the like in the field.

SUMMARY OF THE PRESENT INVENTION

The present invention is particularly designed and constructed to overcome the above disadvantages by providing a bow sight which is strong, compact and fully adjustable for windage without disturbing the range adjustment. Two embodiments of the invention are set forth in the specification, each providing the capability for windage adjustment without disturbing previously made range adjustments.

The present invention generally comprises an elongated block guide member which is vertically attachable to a conventional archer's bow above the handle and arrow rest. This block member is provided with an elongated slot which extends transversely through the block for slidably receiving a plurality of sighting pins.

These sighting pins are threaded and are provided with sighting beads at one end thereof and a knurled handle or knob at the other end for making thumb adjustments as will be hereinafter set forth.

The means for holding the pin in place within the vertical slot in both cases utilizes a nut plate which is engageable with one side of the block and is shaped to extend partially into the slot and prevent rotation of said nut plate with respect to the block member. The pin is then threadedly held in place by the nut plate and is secured in a desirable vertical position by means of an oppositely disposed nut member which in one embodiment is threaded directly on the pin itself and the other embodiment is threaded onto a boss or extension of the nut plate.

In the first embodiment where the nut is threaded directly onto the pin itself a rubber grommet or washer is disposed about the pin and a portion thereof extends into the slot with the flange portion disposed between the nut and the block member. Therefore, upon tightening the nut, the pin member is locked into a vertical position within the slot. However, the pin itself may be rotated by means of the knurled thumb screw in order to move the sighting bead at the opposite end of the pin horizontally to allow for various windage conditions.

In the second mentioned embodiment where the nut member is threadedly disposed upon a threaded boss portion of the nut plate, again the horizontal position of the bead may be changed by simply rotating the pin within the nut plate.

In this particular embodiment it is not absolutely necessary, but it is desirable to have a windage locking means threadedly which amounts to a nut threadedly disposed on the pin adjacent to the nut plate which may be tightened against said nut plate.

In either case, it is readily apparent that the present invention provides a simple and efficient sighting device which may be adjusted for both range and windage and wherein the windage adjustment may be made without disturbing the range adjustment.

DESCRIPTION OF THE DRAWINGS

Other and further advantageous features of the present invention will hereinafter more fully appear in connection with a detailed description of the drawings in which.

DETAILED DESCRIPTION OF THE INVENTION

Figure 1:
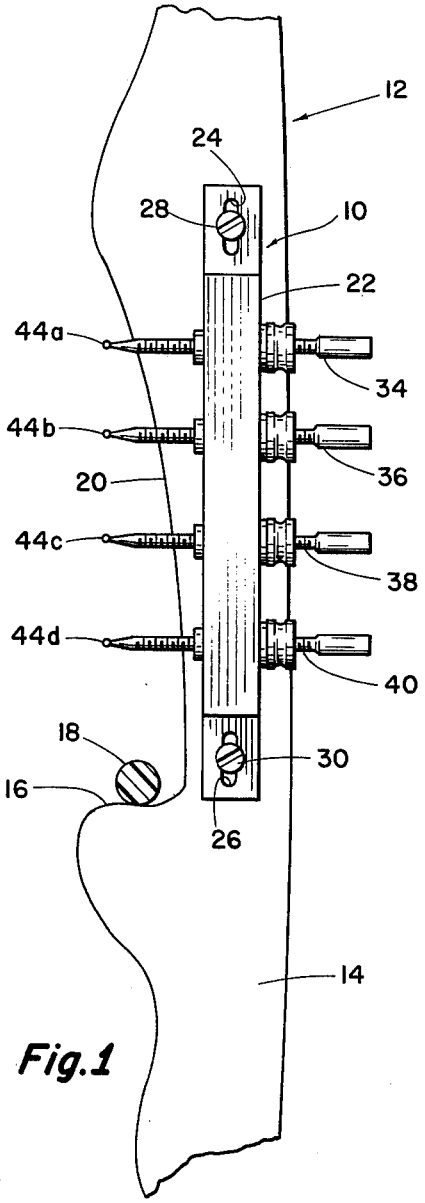
FIG. 1 is a front elevational view of a portion of an archer's bow equipped with a sighting mechanism embodying the present invention.
Figure 2:
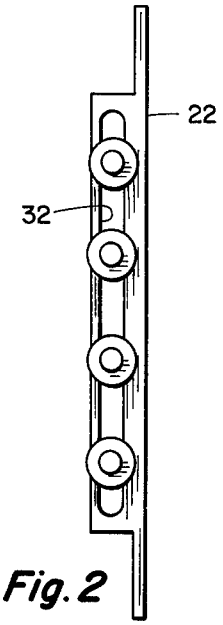
FIG. 2 is a side elevational view of the sighting mechanism of FIG. 1.
Figure 5:
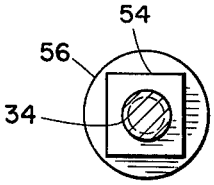
FIG. 5 is a sectional view of the nut plate taken along the broken lines 5—5 of FIG. 4.
Figure 6:
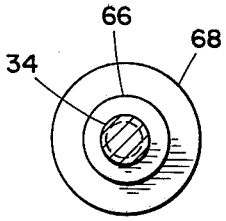
FIG. 6 is a sectional view depicting a washer member and taken along the broken line 6—6 of FIG. 4.
Figure 3:
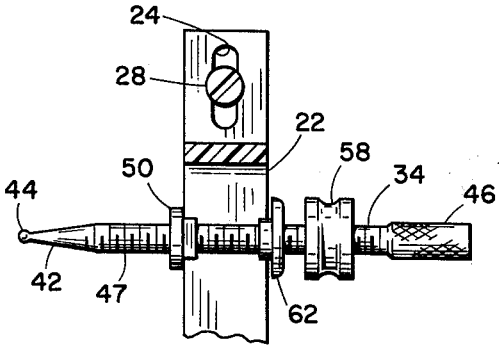
FIG. 3 is a partial sectional view of one of the sighting pins of FIG. 1.
Figure 4:
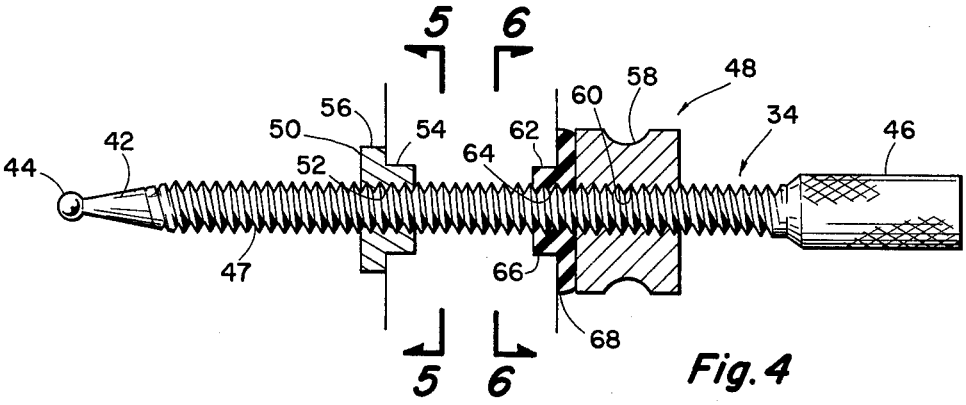
FIG. 4 is an enlarged sectional view of the sighting pin of FIG. 3.
Figure 7:
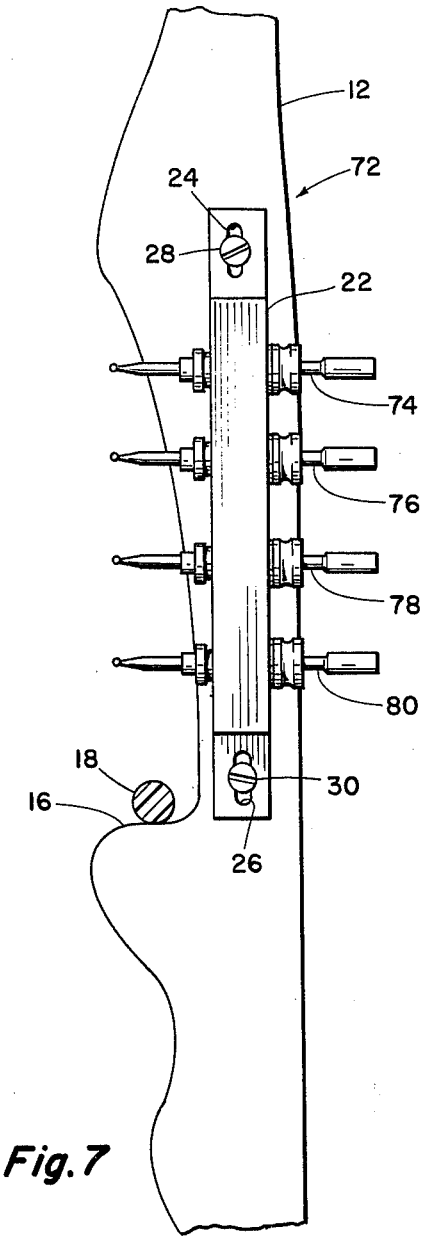
FIG. 7 is a partial elevational view of a conventional bow having a bow sight representing the second embodiment of the invention.
Figure 8:
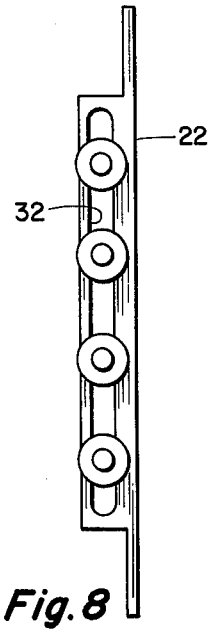
FIG. 8 is a side elevational view of the bow sight of FIG. 7.
Figure 11:
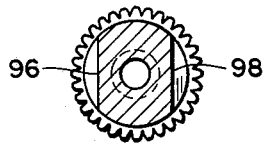
FIG. 11 is a detailed sectional view of the nut plate of FIG. 10 taken along the broken lines 11—11 of FIG. 10.
Figure 12:
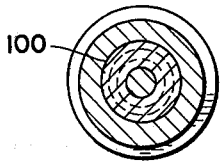
FIG. 12 is a detailed sectional view of the nut and pin shown in FIG. 10 taken along the broken lines 12—12 of FIG. 10.
Figure 9:
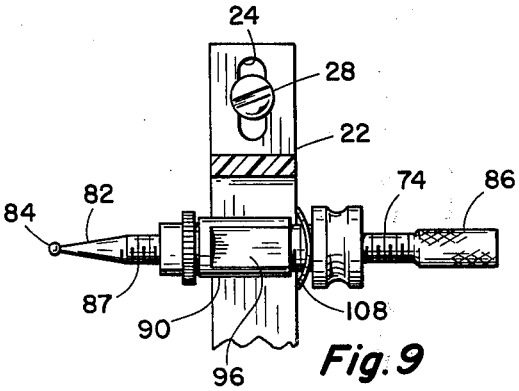
FIG. 9 is a partial sectional view of the sighting mechanism of FIG. 7.

Referring to the drawings in detail, and to FIGS. 1 through 6 in particular, reference character 10 generally indicates a bow sight mechanism which is affixed to a conventional bow 12 having a handle portion 14 and an arrow rest 16 for slidably receiving an arrow 18 thereon. The bow 12 is provided with a cut-away portion 20 which is directly above the arrow rest and often referred to as the sighting window.

The sighting mechanism 10 generally comprises a block member 22 which may be made with any suitable material such as the various forms of plastic. The block member 22 is an elongated and normally vertically attached to the bow above the handle 14 adjacent to the arrow rest 16 as shown in FIG. 1. This particular attachment shows the mechanism located on the back side of the bow or the portion of the bow opposite the bow string (not shown).

The block member 22 is provided with screw slots 24 and 26 at each end thereof for receiving wood screws 28 and 30 therethrough. The block member 22 may take on various shapes to fit the various curvatures of the bow at the point of attachment and may also be attached by other means than the screw and slot configuration shown in the drawings.

The block 22 is also provided with a vertically disposed slot 32 running transversely therethrough. A plurality of elongated sighting pins 34, 36, 38 and 40 are horizontally disposed through the slot 32 and vertically movable therein.

The pins 34, 36, 38 and 40 are identical, each having a tapered end portion 42 terminating in a bead or ball member 44*a*, *b*, *c* and *d* at the end thereof. The opposite end of the pin 34 is provided with a knob or knurled member 46 to facilitate rotation of the pin about its longitudinal axis. The length of the pin between the knob 46 and the tapered portion 42 is provided with a plurality of thread members 47. Each of the sighting ball pins 44*a*, *b*, *c* and *d* are of different colors to assist the archer in remembering the range for each pin.

The attachment and adjustment means generally indicated by reference character 48 is carried by the pin 34 and engageable with the block member 22 for adjusting and holding the pin in its desired location within the slot 32.

The attachment and adjustment means 48 generally comprises a nut plate member 50 having a threaded bore 32 therethrough. The nut plate 50 has a rectangular cross sectional shaped portion 54 at one end thereof having side dimensions approximately that of the width of slot 32 so that when that portion 54 of the nut plate 50 is inserted within the slot 52 it is vertically slidable therein but is nonrotatable. The opposite end portion 56 of the nut plate 50 has a dimension larger than the width of the slot 32. The pin member 34 is installed through the slot 32 and threadedly journaled within the threaded bore 52 of the nut plate 50.

A nut member 58 having a threaded bore 60 therethrough is threadedly disposed on the pin 34 on the opposite side of the block member 22, the diameter of the nut member 58 being also larger than the width of slot 32.

Interposed between the nut member 58 and the side of the block member 22 is a rubber like washer member 62 having a bore 64 therethrough. The washer 62 has a reduced end portion 66 which may be fed into the slot 32 and an outer flange portion 68 which is disposed between the side of the block 22 and the nut member 58.

In use, when it is desirable to calibrate the sighting mechanism, normally the archer will travel to a target range and adjust the vertical position of the various sighting beads 34, 36, 38 and 40 in accordance with various range distances. For instance, the upper sighting bead 34 may be set for a range of 25 yards, 36 set for a range of 40 yards, 38 for 65 yards and 40 for 100 yards. When the various sighting pins are located in their desired vertical position the nut member 58 is tightened against the washer 62 thereby pulling the nut plate 50 snugly against the side of the block 22. Since the sighting pin 34 is threadedly disposed through the nut plate 50 and the nut member 58 the said pin may be rotated by use of the knurled handle member 46 in order to horizontally adjust the bead member 44 to the desirable windage position. The rubber like washer 62 provides a great deal of friction between the nut member 58 and the side of the block member 22 in order to prevent the said nut member 58 from either tightening when the sighting pin is rotated in one direction or loosening when it is rotated in the opposite direction.

Therefore, it is apparent that the vertical position of each pin is locked into place by means of the nut member 58 and nut plate 50 while the horizontal position may be adjusted by rotation of the pin member 34 by its longitudinal axis. Also it is noted that the frictional drag between the pin member and the bore 64 of the washer 62 eliminates the necessity of having a separate locking mechanism for the wind adjustment. However, if it is desirable to firmly lock in the windage adjustment another nut member may be added to the end of the pin member 34 adjacent to nut plate 50 for tightening thereagainst.

Figure 10:
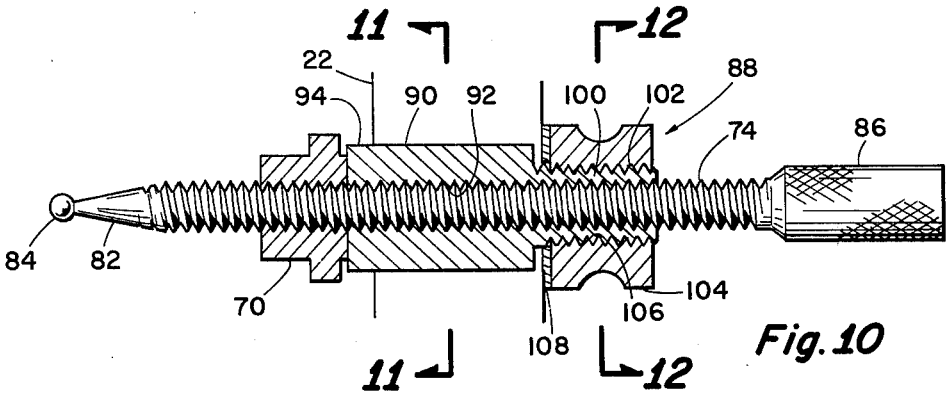
FIG. 10 is a detailed sectional view of the sighting pin of FIG. 9.

This feature is desirable in the next embodiment to be described and is shown in FIG. 10 by way of the windage locking nut member 70 which will be hereinafter described.

Referring now to the drawings and particularly to FIGS. 7 through 12, a second bow sight mechanism generally indicated by reference character 72 will be described. The common elements between the embodiment 72 and the embodiment 10 will carry the same reference characters in order to eliminate the necessity of repeating common material.

The sighting mechanism 72 is attached to the bow 12 in a similar position and utilizing a substantially identical block member 22 having an elongated vertical slot 32 therethrough. The block member 22 may again be attached to any suitable manner to the bow such as by the slots and screws hereinbefore described.

A plurality of sighting pins 74, 76, 78 and 80 are vertically spaced and horizontally disposed through the slot 32. The pin 74 as in the pin 34 is elongated and tapered at 82 to a bead or ball member 84. The various ball members 84 are color coded to assist the archer in multiple range settings. The opposite end of the pin 74 is provided with a knurled handle or knob means 86 for facilitating rotating the pin about its longitudinal axis. Again, the outer surface of the pin between the knob 86 and the reduced portion 82 is provided with a plurality of threads 87.

The attachment and adjustment mechanism generally indicated by reference character 88 comprises a nut plate means 90 having a threaded bore 92 therethrough for threadedly receiving the pin 74. One end 94 of the nut plate 90 may be of circular cross sectional shape having a diameter larger than the width of the slot 32 to prevent the nut plate from passing therethrough. The nut plate 90 is also provided with a midportion having flattened sides 96 and 98 for insertion of the opposite end of a nut plate within the slot 32 whereby the nut plate may be vertically slidable within the slot but not rotatable. The opposite end of the nut plate 90 is provided with a threaded boss portion 100 having a cylindrical cross sectional shape and further having a diameter less than the width of the slot 32. The outer periphery of the boss member 100 is provided with a plurality of threads 102 for purposes that will be hereinafter set forth.

A cylindrical nut member 104 having a threaded bore 106 therethrough is threadedly disposed about the boss member 100. The outer diameter of the nut member 104 is larger than the width of the slot 32. Disposed between the nut member 104 and the side of the block member 22 is a lock washer 108 to prevent inadvertent rotation of the nut after it is tightened as shown in FIG. 10.

In operation, when it is desirable to adjust the sighting mechanisms for range the nut member 104 is loosened and the pin member 74 is adjusted to its desirable vertical position within the slot 32. The nut member 104 is then tightened against the side of the block member 22 with the washer 108 interposed therebetween thereby pulling the end portion 94 of the nut plate 90 against the opposite side of the block member 22 which vertically positions the horizontal pin 74 within the slot 32. The pin 74 may then be rotated to horizontally position the bead member 84 in order to set the windage.

Normally with the tolerances available in such mechanisms it would be desirable to utilize the second nut member 70 which is threadedly disposed on the pin member 74 adjacent the nut plate 90 in order to lock the pin member 74 against inadvertent rotation about its longitudinal axis.

Whereas, the present invention had been described in particular relation to the drawings attached hereto, other and further modifications apart from those shown or suggested herein may be made within the spirit and scope of the invention.

What is claimed is:

1. An archery bow sight adapted for mounting on an archery bow for an aid in directing the longitudinal flight of an arrow and comprising;

a. an elongated guide block vertically attachable to a bow and having a vertically disposed elongated slot extending transversely through the guide block;

b. at least one elongated sighting pin horizontally adjustable for windage adjustment through and vertically slidable within said elongated slot, said at least one sighting pin being provided with a plurality of threads around the outer periphery thereof terminating at one end with a sighting bead thereon;

c. range locking means carried by said at least one sighting pin engageable with the guide block for selective locking of said at least one pin in said at least one desired vertical location within the slot and wherein the range locking means comprises a nut plate engageable with one side of the guide block and having a threaded bore therethrough for threadedly receiving the pin, anti-rotation means carried by the nut plate and engageable with the elongated slot to prevent rotation thereof, a nut member disposed opposite the nut plate on the opposite side of the guide block, a washer of resilient material interposed between the nut member and said opposite side of the guide block whereby tightening said at least one nut member against said opposite side of the guide block with said washer therebetween permits selective locking of the sighting pin in the desired vertical position within the slot and whereby increased friction between said at least one guide block and nut member caused by the washer prevents rotation of said at least one nut member when said at least one sighting pin is rotated for windage adjustments.

2. An archery bow sight as set forth in claim 1 wherein the washer is of a rubber like material such that when the nut member is tightened against the side of a guide block with the washer therebetween, the increased friction created by said rubber washer is such that the threads of said at least one pin member may be rotated within the threads of the nut member without causing rotation of the nut member.

3. An archery bow sight as set forth in claim 2 wherein the rubber washer includes an inwardly extending boss portion insertable within the elongated slot, said boss portion having a bore therethrough for threadedly receiving said at least one sighting pin therethrough.

4. An archery bow sight as set forth in claim 1 and including a second nut member threadedly disposed on said at least one sighting pin adjacent the nut plate and engageable therewith for locking said at least one sighting pin against further rotation.

5. An archery bow sight adapted for mounting on an archer's bow for aid in directing the longitudinal flight of an arrow and comprising;

elongated guide block vertically attachable to a bow and having a vertically disposed elongated slot extending transversely through the guide block;

at least one elongated sighting pin horizontally disposed through and vertically slidable within said elongated slot, said at least one elongated sighting pin having external threading and terminating with a sighting bead on one end thereof;

range locking means carried by said at least elongated sighting pin and engageable with the guide block for selective locking of said at least one elongated pin in the desired vertical location within the slot said range locking means comprising a nut plate means engageable with one side of the guide block, anti-rotation means carried by the nut plate and engageable with the elongated slot to prevent rotation thereof, a threaded boss on one end of the nut plate and extending through the slot to the opposite side of the guide block, a nut member threadedly disposed on the boss adjacent said opposite side of the guide block, a washer disposed on the boss between the nut member and said opposite side of the guide block;

windage adjustment means cooperating between said at least one elongated pin and the range locking means and capable of permitting horizontal positioning of said at least one pin without disturbing the range locking means, said windage adjustment means comprises an internal threaded bore extending through the range locking means for threadedly receiving said at least one sighting pin therethrough;

whereby tightening of the nut member against said opposite side of the guide block with said washer therebetween permits selective locking of said at least one sighting pin in the desired vertical position within the slot while permitting said at least one elongated pin member to be rotated about its longitudinal axis for windage adjustments.

6. An archery bow sight as set forth in claim 5 and including a second nut member threadedly disposed on said at least one sighting pin adjacent the nut plate and engageable therewith for locking said at least one sighting pin against further rotation.

* * * * *